United States Patent [19]

Yagi et al.

[11] 4,423,532

[45] Jan. 3, 1984

[54] DUSTER

[75] Inventors: Akira Yagi, Takatsuki; Haruo Nishimura, Osaka; Shinji Bandai, Kawanishi; Masao Kajimaki, Ibaragi; Yoshihiro Nakajima, Osaka; Noriyuki Matsumoto, Toyonaka, all of Japan

[73] Assignee: Duskin Franchise Kabushiki Kaisha, Osaka, Japan

[21] Appl. No.: 256,835

[22] Filed: Apr. 23, 1981

[51] Int. Cl.[3] ..... A47L 13/40

[52] U.S. Cl. ..... 15/182; 15/145; 15/226

[58] Field of Search ..... 15/223, 145, 225, 182, 15/199, 226

[56] References Cited

U.S. PATENT DOCUMENTS

| | | | |
|---|---|---|---|
| 698,880 | 4/1902 | Warren et al. | 15/225 X |
| 818,497 | 4/1906 | Whittemore | 15/182 X |
| 1,371,601 | 3/1921 | Braun | 15/182 X |
| 1,979,240 | 11/1934 | Adelmann | 15/198 |
| 4,305,173 | 9/1979 | Isao | 15/1.5 A |

*Primary Examiner*—Chris K. Moore

*Attorney, Agent, or Firm*—Cushman, Darby & Cushman

[57] ABSTRACT

A duster of an improved type for dust capturing efficiency, comprising a cylindrical stem with a continuous spiral thread extending along a portion thereof, a grip engaged with said stem, and fabric materials comprising a band of fiber or fibril bundles which are made of a ductile synthetic resin film or foil which has been split into fibers or fibrils and crimped. The bundles are arranged in a meandering manner. One edge of the band comprises loose edges while the other edge is held together by one or more strings. The secured edge is disposed within the thread with the ends of said material being engaged, respectively, by a supporting member provided at the tip of said stem and an engaging member provided at the root portion of the thread.

2 Claims, 32 Drawing Figures

DUSTER

BACKGROUND OF THE INVENTION

1. Field of the Invention

This invention relates to a duster, and more particularly to one suitable for capturing fine particle dusts.

2. Description of the Prior Art

Various kinds of dusters utilizing electrical charging phenomena have previously been proposed.

Prior dusters have utilized electrical charging wherein the article is charged with either positive or negative polarity, which causes a strong external electric field to be established which often gives an unpleasant feeling to a user.

Even though the dusts are initially captured, they are apt to drop off due to an easy transfer of the electric charge, and the dusts once having fallen are apt to escape from the duster because of a repulsion phenomenon, which prevents recapture of the dusts.

SUMMARY OF THE INVENTION

To overcome such drawbacks in the conventional art, an improvement has been developed in an electret system. This electret system is the so called "permanent electric polarization" in which the article, once having been charged, maintains a bipolar charged condition semi-permanently or perpetually thereby producing only a small external electric field. As a result, no unpleasant feeling is given to a user due to the electric charge. Furthermore, the charges are not transmitted to the dusts, the latter of which seldom fall down, but which nevertheless are recapturable even should they fall. These advantages are available in this system.

This invention provides the dusters employing the electret system with a simple design and easy fabrication which assures dust capture. Polyolefin resin film, such as polyethylene or polypropylene, or any other convenient chemical providing equivalent characteristics, may be used for the duster material.

A primary aspect of this invention relates to a duster comprising a cylindrical stem with a continuous radial thread extending from its tip towards a root portion spaced along the stem. A band of material is formed from a plurality of bundles of fibers or fibrils made from a ductile synthetic resin film, which has been charged to the electret state, split into yarns and crimped. The bundles are arranged in a meandering manner. One edge of the band comprises loose ends, the other edge being held together by one or more strings. The material is wound around the radial thread, the tip end of which is engaged with a supporting member and the other end of which is provided with a notch at the root portion of the stem.

The duster further comprises a grip which is mated and/or threadably secured to the root portion of said stem.

BRIEF DESCRIPTION OF THE ACCOMPANYING DRAWINGS

DESCRIPTION OF THE PREFERRED EMBODIMENTS

The preferred embodiments of this invention will be hereinafter discussed in detail with reference to the accompanying drawings.

For the definition of the terms, several explanations will be given hereunder.

Synthetic resin film of the type identified above when elongated or stretched to the maximum becomes extremely thin film or foil and has remarkable tensile strength. This foil is moved longitudinally onto a needle roller and/or a roller with thin blades or pins to produce a plurality of thin slits, creating bundles of continuous fine fibers or fibrils.

This treatment or operation is called "splitting-fibers or fiber-splitting". The thus treated film is then subjected to a heat-treatment and given a crape to become crimped thereby producing a soft-touch texture having a combined effect in the finely divided or split fibrillated film which is similar to feathers.

This invention provides dusters employing the electret system with fibers split and crimped so as to achieve a simple design having highly improved dust capturing efficiency.

Figure 11:
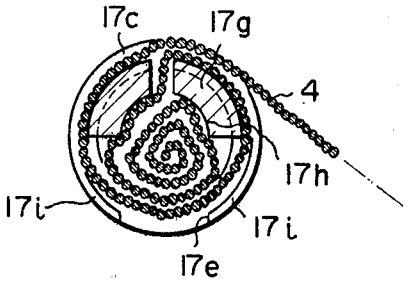
FIG. 11 is a sectional view of the supporting member illustrating how the fabric material is attached thereto.

A primary aspect of this invention is a duster comprising a cylindrical stem 5 (FIG. 2) with a continuous thread 6 extending from a forward tip end towards a root portion spaced from the opposite end of the stem 5. A grip 18 (FIG. 1) threadably mates with the root portion of said stem 5, said root portion being provided with an engaging or fixture means having a generally L-shaped notch or slit 12 for securing split and crimped yarn bundles 1 of ductile synthetic resin which have been electrically charged, each of which is arranged in a meandering manner with one edge being engaged with one or more strings formed in a loop 2 to produce a fabric material 4. The tip end portion of the stem is provided with an opening extending between the side portions of said stem 5. The depth of said opening reaches a position beyond the center of said stem 5 where it narrows for the remaining width portion of the stem. One end of the fabric material 4 is inserted into said opening above its thread-engaged edge with a portion of the fabric being wound about itself (FIG. 11). The remaining material extends from said wound portion through the narrowed opening and is wound about the thread 6 formed on the circumferential wall of the stem 5. A terminal end of said material 4 is forcibly inserted within the generally L-shaped notch 12 provided on said root end of the stem 5 thereby permitting a secure fixing thereof.

Figure 1:
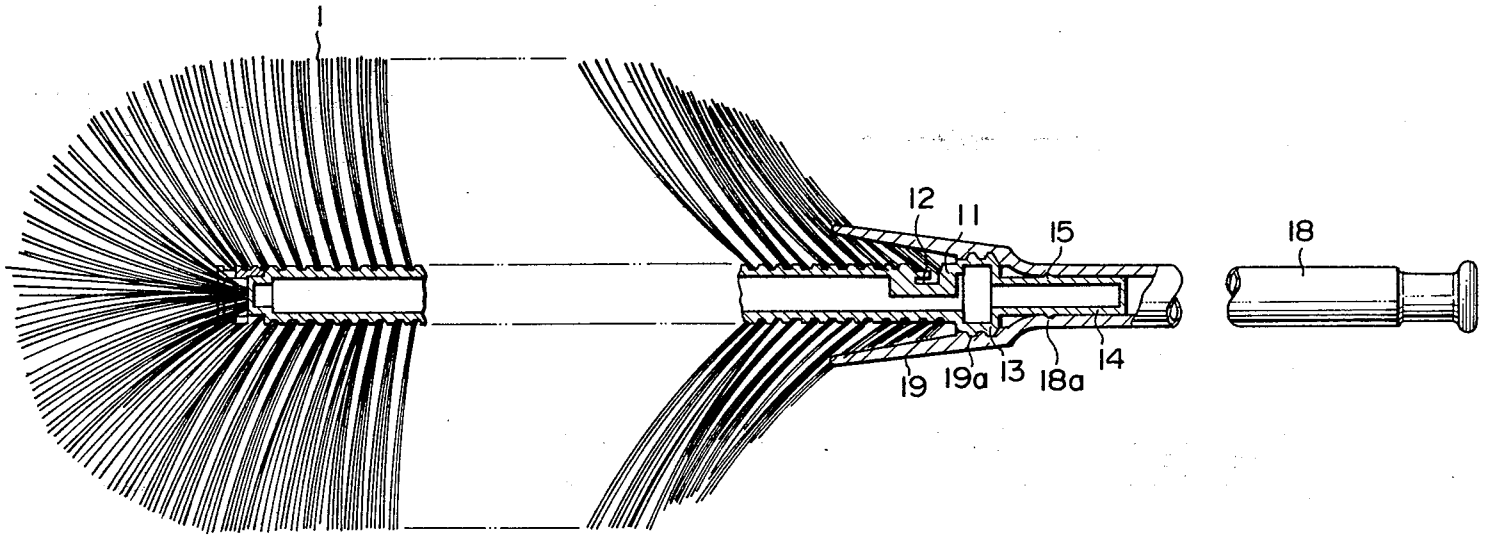
FIG. 1 is an elevational view partially in section of a duster according to a preferred embodiment of this invention.
Figure 9:
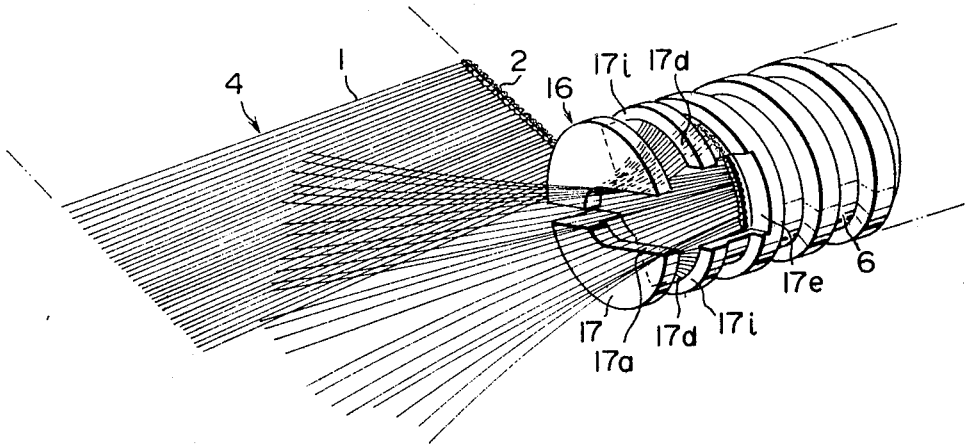
FIGS. 9 and 10 are perspective views illustrating how fabric is attached to the supporting member.

FIGS. 1 and 9 show a plurality of fiber bundles 1 made of polyolefin synthetic resin film which has been stretched to its maximum elongation to form a thin film, charged to the electret state, split into fibers and crimped. These yarn bundles 1 are arranged in a meandering manner and are, as shown in FIG. 9, of a predetermined length with the bundles in adjacent rows being formed to contact each other. At one side, the ends of the fibers are loose, while at the other loops 2 are knitted or sewn together with one or more strings 3 to form a fabric material 4 of predetermined length and width.

A cylindrical member 7 (FIGS. 1 and 2) protrudes from a forward tip end of the stem 5, and the radius of the member 7 is smaller than that of the stem 5. An annular ridge 8 is formed around the circumferential wall of the member 7 intermediate its ends.

Formed on the circumferential wall of said cylindrical member 7 is a generally straight recess 9 extending axially thereof and traversing the ridge thereon. The recess serves as a positioning member for the support member 16 which will be discussed later in detail.

Figure 2:
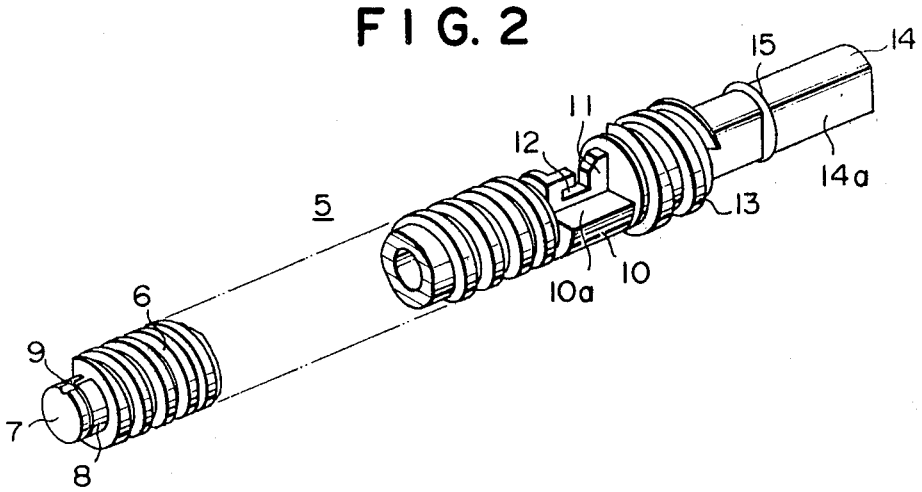
FIG. 2 is a perspective view of the stem portion of the duster shown in FIG. 1.

FIG. 2 shows the stem 5 being formed near the root portion of thread 6 with a generally semi-circularly formed D-shaped cut 10 to define identical plane platforms or steps 10*a* on the stem. A generally L-shaped curved notch 12 extends from steps 10*a* axially of the stem 5 at its center.

Continuously formed adjacent said D-cut on the stem 5 is a male thread 13 having a relatively larger diameter than thread 6. The thread 13 is sandwiched between the D-cut and a mating member 14 having plane surfaces 14*a* at its opposite side walls. Member 14 also defines an annular ridge 15 on the stem.

Figure 3:
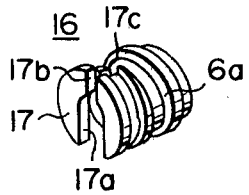
FIG. 3 is a perspective view of a supporting member utilized with the embodiment of FIG. 1.
Figure 6:
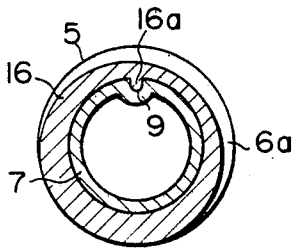
FIG. 6 is a view taken along line A—A in FIG. 5.

FIG. 3 shows a supporting member 16 having a threaded portion 6*a* corresponding to the radial thread 6 on the stem 5. This member 16 is formed at its threaded end with a ridge 16*a* (FIG. 6) on its inner circumferential wall which is matable with the recess 9 of the cylindrical member 7 previously discussed.

Formed at the end of said support 16 forwardly of thread 6*a* is a front plate 17 covering said support. The plate 17 has a generally U- or V-shaped notch or slit 17*a*, an inner end of which merges with a narrower notch 17*b*, which in turn connects with still another notch 17*c* formed of a predetermined axial length along the support 16.

On the side of member 16 opposite to the notch 17*c*, and inwardly of the front plate 17, is a generally semi-circular opening 17*d* (FIG. 5) which faces notch 17*a* and communicates with a further notch 17*e* formed along the length of support member 16.

An annular recess 17*f* is formed in the inner-circumferential wall of the support 16 at the end thereof opposite plate 17. This recess receives the annular ridge 8 formed on the circumferential wall of the cylindrical member 7 of the stem 5.

Figure 5:
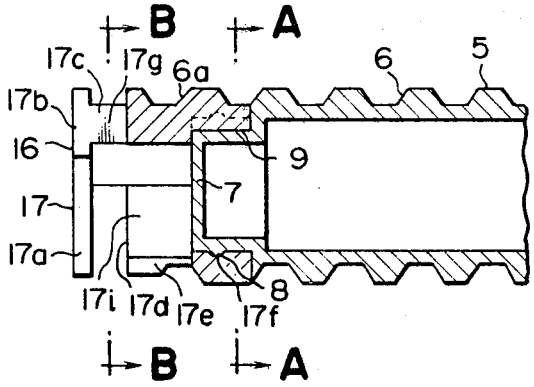
FIG. 5 is an enlarged sectional view of the supporting member shown in FIG. 3.

As shown in FIG. 5, the support 16 has a semicylindrical thick member 17*g* on a side of member 16 opposite to the side where opening 17*e* is formed. The cross sectonal view in FIG. 11 illustrates an arcuate notch 17*h* formed opposite to the notch 17*e* of this semi-cylindrical member 17*g* and its radius is larger than that of the inner end of notch 17*a*. These notches 17*b*, 17*c* are formed transversely across the semicylindrical member 17*g*.

Figure 7:
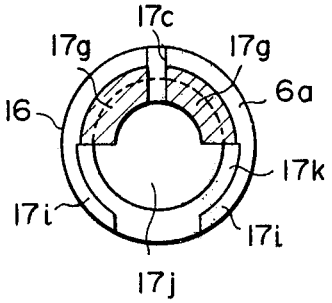
FIG. 7 is a view taken along line B—B of FIG. 5.
Figure 8:
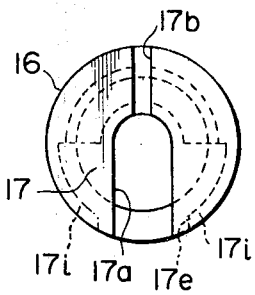
FIG. 8 is an enlarged front view of the supporting member shown in FIG. 3.

Extending from both ends of said semi-circular member 17*g* along the circumferential outer wall of the support 16 are arcuate side walls 17*i* (FIGS. 5 and 7) the tip ends of which define said opening 17*e* and the upper end rims of each of which define an arcuate opening at a lower surface of said front plate 17. These arcuate side walls 17*i*, 17*i*, the semiarcuate cylindrical member 17*g* and the front plate 17 define an inner space 17*j*.

Since these side walls 17*i*, 17*i* are relatively thin, the root portion protrudes uprightly from said thick portion 17*g* of the support 16, and there are also formed from the inner side toward the opening 17*e* of the side walls 17*i*, 17*i*, arcuate steps 17*k* which, upon mating of member 16 with the stem, are positioned flatly with the front of the tip end 7 of the stem 5.

Support 16, after positioning its ridge 16*a* within the recess 9, is pressed against the front surface of the tip end 7 of the stem 5, and it is secured to the stem due to the mating of the ridge 8 within the recess 17*f*. The open end of the U-shaped notch 17*a* faces oppositely to the ridge 11 formed on the root portion of the stem 5.

Figure 4:
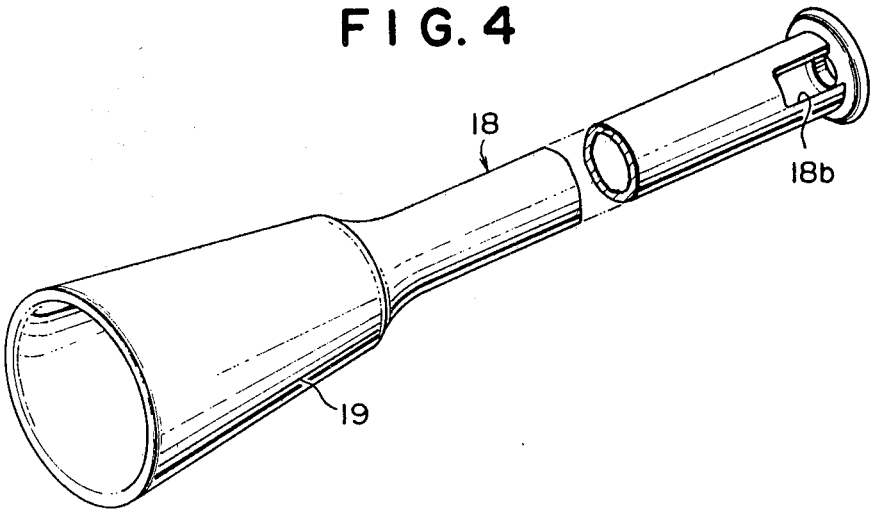
FIG. 4 is a perspective view of the grip portion of the duster shown in FIG. 1.

A grip 18 (FIGS. 1 and 4) is formed in a cylindrical shape with a forward tip end portion 19 having a bell shape around the inner circumferential wall of which is formed a thread 19*a*. This thread mates with thread 13 formed on the root portion of the stem 5. The inner diameter of the cylindrical portion of grip 18 is nearly equal to the diameter of the arcuate faces of member 14 formed at the opposite end of said stem 5 from member 7. An annular recess 18*a* is provided on an inner circumferential wall of grip 18 near the bell 19 for mating with ridge 15 on stem 5 when the grip 18 is completely threadably mated with the stem by means of screws 13 and 19*a*.

An explanation as to how the fabric material 4 is secured to the stem now will be presented.

The support 16 is first joined to member 7 at the tip end of the stem 5, as previously described. In this state, bundles of the material 4 are tightly rolled together (FIG. 11) such that a diameter of the edge which has been spirally sewn, stitched or knitted with the strings 2 will be larger than the width of the notch 17*e* provided on the support 16 when the roll relaxes. The edge engaged (sewn, stitched or knitted) with strings 2, with the aid of notches 17*e* and 17*a*, is forcibly inserted within the space 17*j* formed between the front plate 17 and the circumferential support walls.

Figure 10:
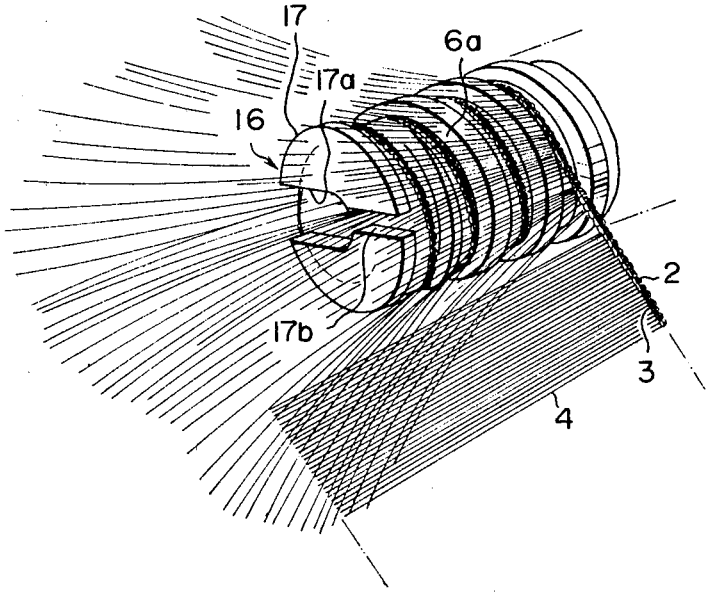

As the material 4 is inserted within the space 17*j*, it first is deformed but then spreads out within the space. However, the edge of the fabric engaged by the strings 2 never comes out of the notches 17*a* and the opening 17*d* because of the larger diameter of the roll of material within space 17*j*. The free ends of the material 4 protrude outwardly from the notch 17*a* (FIGS. 9 and 10).

The fabric material 4 extending from that spirally wound within space 17*j* passes outwardly from the support 16 through the notches 17*b* and 17*c* and the edge engaged by the strings 2 is wound around support 16 along the thread 6*a* formed on the circumferential wall of the support 16.

The material 4 wound around the thread 6*a* presses material 4 within the notch 17*d* against the semi-circular cylindrical member 17*g*. Accordingly, it prevents the material 4 from coming out of the space 17*j* in the support.

The portion with the notch 17*e* and having no thread 6*a* also serves to hold the material 4 within the inside of the support 16. The continuity of thread 6*a* on the support 16 with thread 6 of the stem 5 permits the material 4 to continue to be wound along stem 5 from the support 16.

The material 4 after being wound onto the thread 6 is forcibly inserted within the curved narrow space of the L-shaped notch 12 and is fixed therein.

After the material 4 has been thus wound, the grip 18 is screwed onto the stem 5, whereupon the annular ridge 15 formed on portion 14 of the stem 5 is mated within the recess 18*a* formed on the inner circumferential wall of the grip 18 (FIG. 1).

An opening 18*b* (FIG. 4) is formed at the rear end of the grip 18 for hanging it on a hook.

The duster which has been described permits the fibers or fibrils of the fabric material 4 to spread radially from the tip end of the stem 5 with the aid of the support 16, and its appearance is not only aesthetic and elegant, but also the end of the support 16 is never exposed and hence the duster never damages furniture during cleaning.

Figure 12:
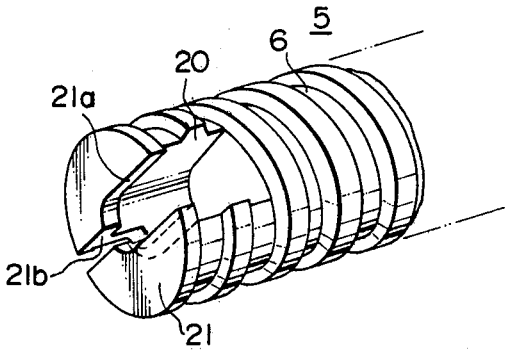
FIGS. 12–14 are enlarged perspective, front and sectional views showing an alternative embodiment of the invention.
Figure 13:
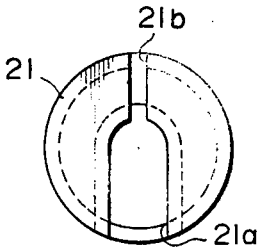
Figure 14:
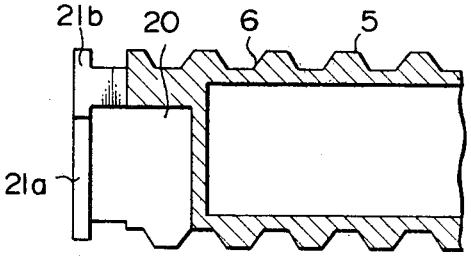

FIGS. 12–14 illustrate a modification of the support 16 in that it is designed integral with the stem 5. It is formed with a U-shaped space 20 at the tip end of the stem 5 open at the side. A front plate 21 is located at the forwardmost part of the tip end, and a notch 21*a* having a width narrower than said space 20 is provided in the front plate 21 in communication with said space 20. A notch 21*b* formed in the front plate 21 communicates with both the space 20 and the notch 21*a*.

Thus the modified duster also permits the fibers or fibrils of material 4 to protrude from the stem 5 tip end in a manner similar to the support 16 previously discussed. Since the open side of the space 20 is sealed when the material 4 is wound around the thread 6, the material contained in space 20 can not come out outwardly. The notch 21*a* having a width narrower than the width of the space 20 prevents the material contained within the space 20 from coming out of the notch 21*a*.

Figure 15:
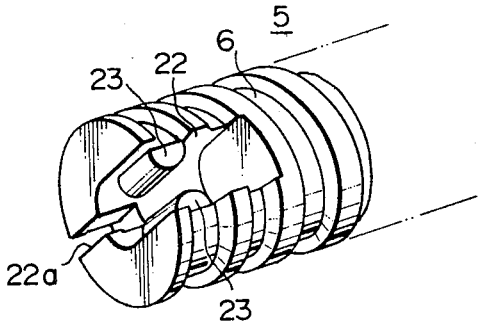
FIGS. 15–17 are enlarged perspective, front and sectional views of a still further embodiment of the invention.
Figure 16:
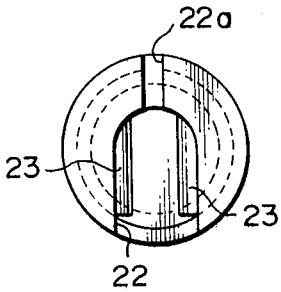
Figure 17:
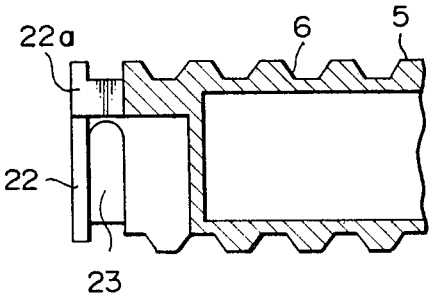
Figure 18:
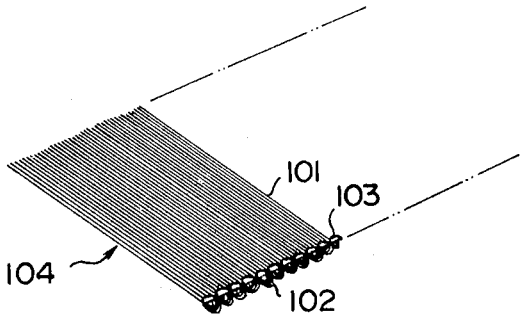
FIG. 18 is a perspective view of a fabric suitable for use with the invention.
Figure 19:
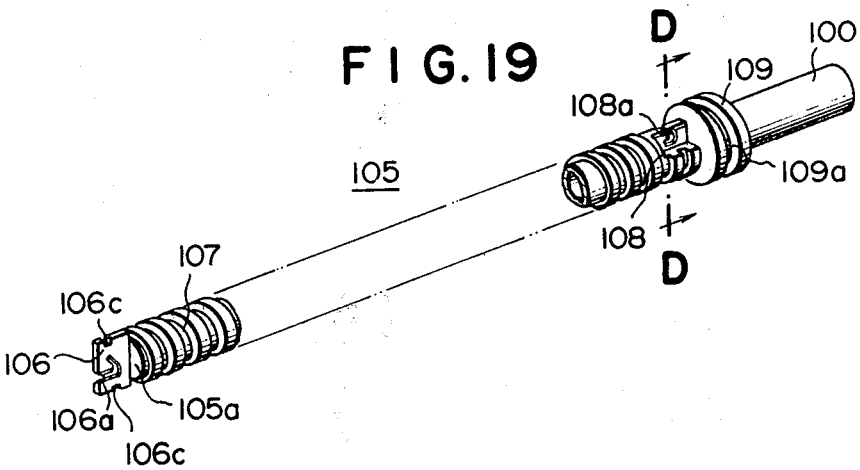
FIG. 19 is a perspective view of a modified stem portion of a duster.
Figure 20:
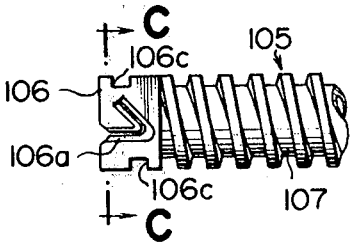
FIG. 20 is an enlarged side elevational view of the forward end of the stem shown in FIG. 19.
Figure 21:
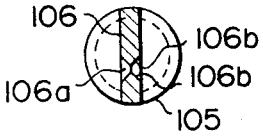
FIG. 21 is a sectional view taken along line C—C in FIG. 20.
Figure 22:
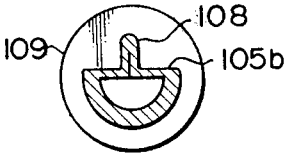
FIG. 22 is a sectional view taken along line D—D in FIG. 19.
Figure 23:
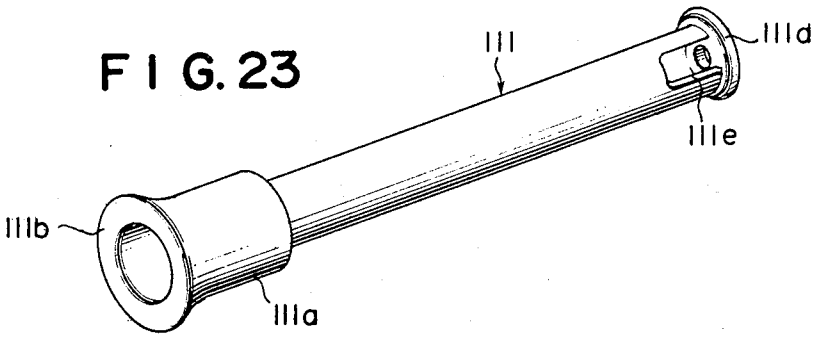
FIG. 23 is a perspective view of the grip utilized in conjunction with the stem shown in FIG. 19.
Figure 24:
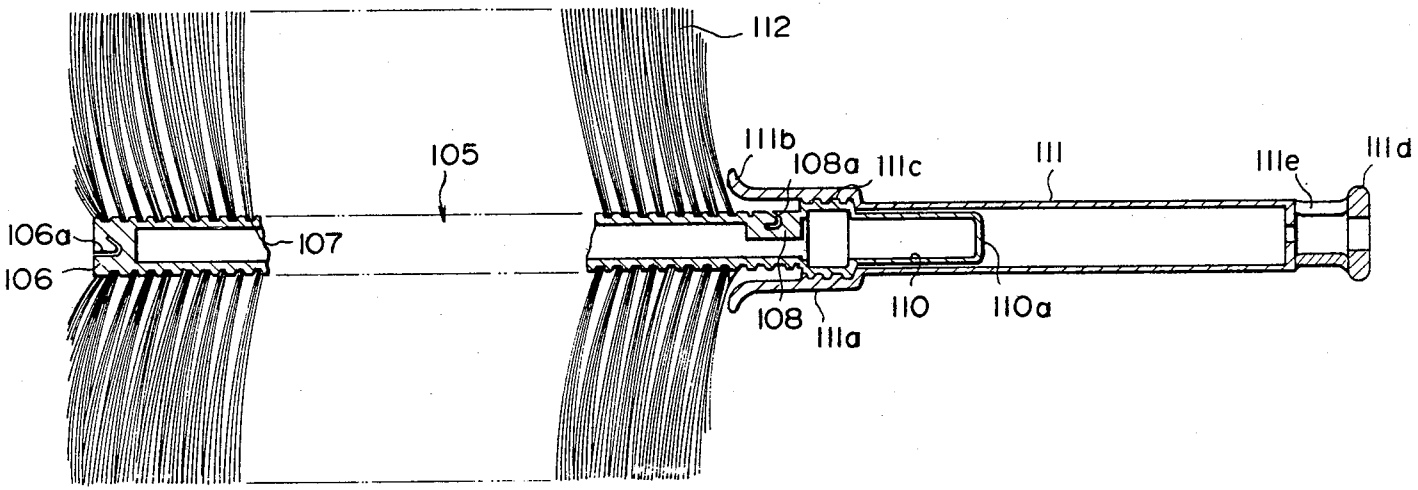
FIG. 24 is a sectional view of a modified duster utilizing the components shown in FIGS. 18–23.
Figure 25:
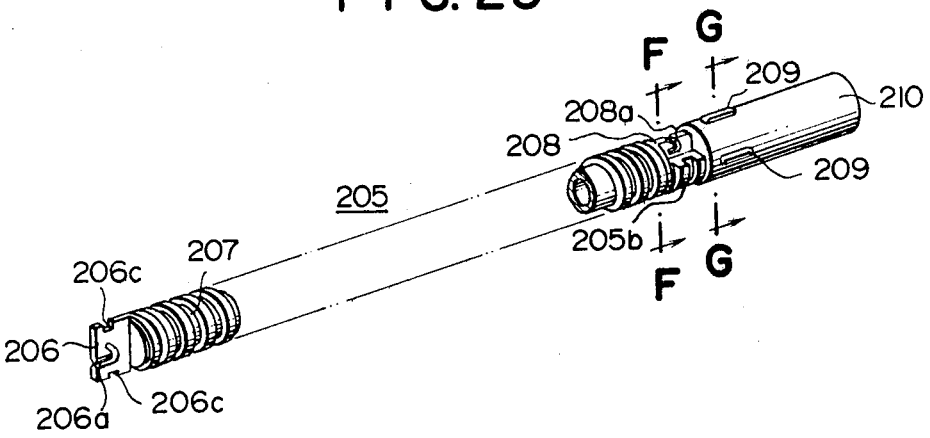
FIG. 25 is a perspective view of a still further modification of the stem portion of a duster.
Figure 26:
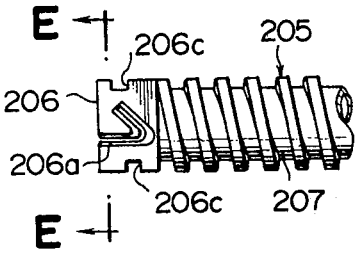
FIG. 26 is an enlarged fragmented elevational view of the tip end of the stem shown in FIG. 25.
Figure 27:
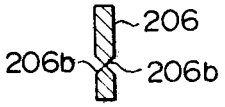
FIG. 27 is a sectional view taken along line E—E in FIG. 26.
Figure 28:
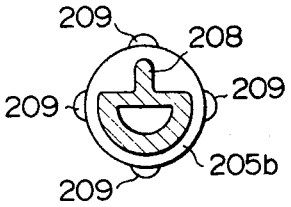
FIG. 28 is an enlarged sectional view taken along line F—F in FIG. 25.
Figure 29:
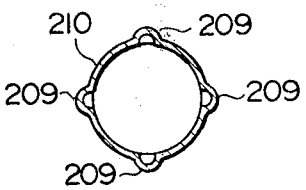
FIG. 29 is an enlarged sectional view taken along line G—G in FIG. 25.

FIGS. 15–17 illustrate a further modification of the support similar to the embodiment shown in FIGS. 7–12. Although this support has an internal space 22 open at the side of the stem 5, the space 22 extends forwardly to open at the forward tip end of the stem 5. A pair of steps 23 having semi-circular cross sections are provided in spaced relationship intermediate the ends of the inner circumferential wall of space 20. The width of the space 22 is narrowed where these steps 23 are positioned. A notch 22*a* is formed on the forward tip end of the stem 5 so as to communicate with the space 22. The thus designed stem permits the material 4 compressed in space 22 to protrude from the tip end of the stem 5 in a manner such that a portion of the material 4 is pressed between the projections 23 assuring that the material 4 does not escape from the tip end of the stem 5. Since the side opening of the space 22 is sealed when the material is wound along the thread 6, the material contained within the space 22 can not move sidewardly out of the space. In the modifications shown in FIGS. 12 and 15, the bottoms of spaces 20, 22 are, of course, closed or sealed.

As apparent from the aforegoing explanations, this invention provides dusters which have designs wherein the tip ends of the stems 5 are open at their sides to form internal open spaces. Narrowed openings are provided at the tip ends of the stems 5 in communication with their respective internal spaces to contain fabric material 4 wound within the spaces. The ends of the material 4 protrude from the stem tip end so that the forward tip end of the stem 5 is never exposed. Dusters made in accordance with this invention offer an elegant appearance and prevent damage to furniture during cleaning. The invention permits easy fabrication of the dusters since the attachment of the material 4 is quite easily made.

A still further modification of the invention is illustrated in FIGS. 18–24. The duster shown has a cylindrical hollow stem 105 with a continuous thread 107 extending from its forward tip end to a position intermediate the end of the duster. In the vicinity of the end of the thread, a large diameter annular ring 109 having at least one recess or thread 109*a* around its outer circumferential wall is provided. At opposite sides of the annular ring 109 are means for mating a grip 111 and the fabric material 104, respectively. The grip 111 is mated to portion 110 by a detachably threaded relationship with the thread 109*a* on the ring 109. The fabric material 104 made of the ductile synthetic resin film is charged to the electret state, fiber-split and then crimped into a plurality of rows of fiber or fibril bundles 101 arranged in a meandering manner in a band-like shape. The bundles 101 are cut at one end while being engaged at the opposite end in any convenient manner (e.g., by being sewn, knitted or stitched) with one or more coil strings 103, leaving loops 102. The forward tip end of stem 105 comprises an integral plate piece 106 formed on said stem 105. Plate 106 is formed with a notch 106*a*, which has a generally L-shape or V-shape extending from its forward end along the axial direction of the stem. The stem 105 has an upright ridge 108 extending along the axial rotation of the stem adjacent the end of the thread 107. A further notch having a generally L- or V-shaped form when viewed from the side of the stem 105, is provided on ridge 108. One edge of said material 104 held together by the strings 103 is continuously wound around the stem within the thread 107. One end of said material 104 is sandwiched within the notch 106*a* of the plate piece 106, and the opposite end is sandwiched within the notch 108*a* of the ridge 108.

A still further modification, as shown in FIGS. 25–29, comprises a duster having a hollow cylindrical stem 205 with a continuous thread 207 extending from its forward tip end to a position intermediate the end of the duster. In the vicinity of the end of the thread, a plurality of ridges 209 are formed to extend along the axial direction of the stem. These ridges are spaced equally around the circumferential wall of portion 210 of the stem. The duster has a grip (not shown, but identical with the numeral 111 in FIG. 23) which is detachably and forcibly inserted onto said stem over said ridges 209. A fabric material 104 (FIG. 18) in a band-like shape is made of a ductile synthetic resin film which has been charged to the electret state, fiber-split and then crimped to produce a plurality of fiber or fibril bundles (identical with those designated 101 in FIG. 18) arranged in a meandering manner. One end of said bundles are cut while the opposite end is engaged with coil strings (numeral 103 in FIG. 18), leaving loops (numeral 102 in FIG. 18). A plate 206 is formed integral with the forward tip end of said stem 205, and plate 206 is provided with a generally L- or V-shaped notch or slit 206*a* extending inwardly. In the vicinity of the end of threads 207, stem 205 is provided with a ridge plate 108 extending axially of the stem, said plate 208 being provided with a notch 208*a* of generally L- or V-shaped form directed inwardly from the side of the plate. The material 104 along the edge engaged by said coil strings 103 is continuously wound around and within said thread 207 of the stem 205. A forward end of said material is sandwiched within said notch 206*a* of the plate 206, and the rear end is sandwiched within said notch 208*a* of the ridge 208.

Figure 30:
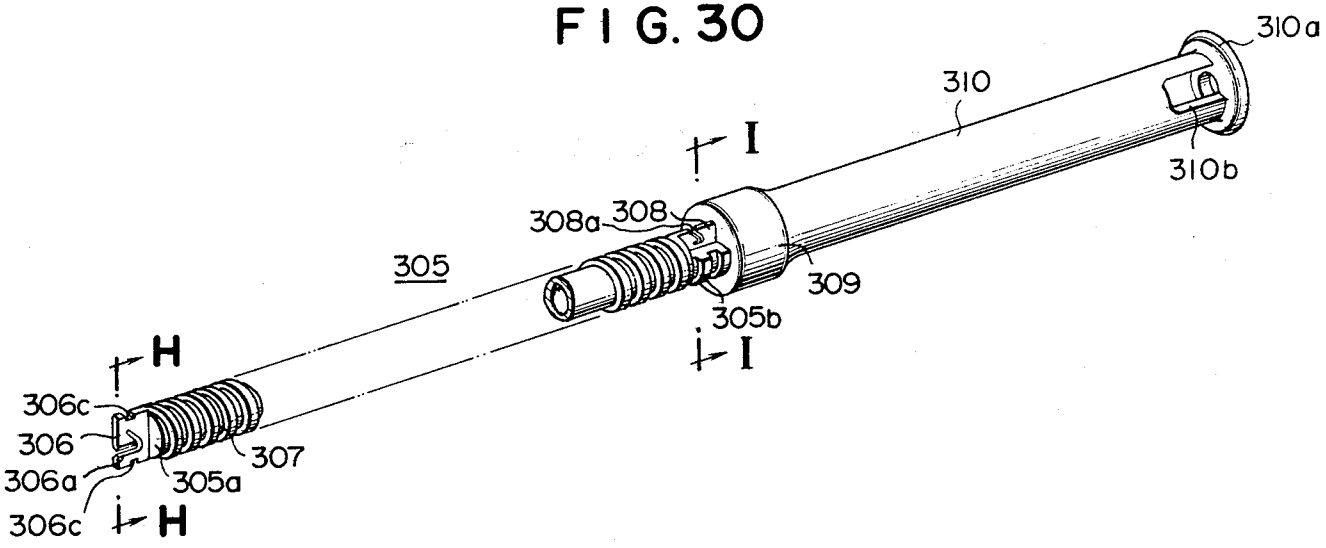
FIG. 30 is a perspective view of a still further modification of the stem portion of a duster.
Figure 32:
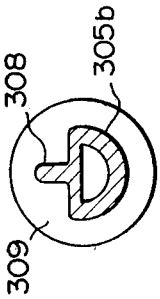
FIG. 32 is an enlarged sectional view taken along line I—I in FIG. 30.
Figure 31:
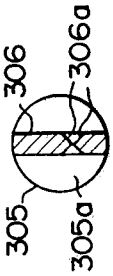
FIG. 31 is an enlarged sectional view taken along line H—H in FIG. 30.

A still further modification, shown in FIGS. 30–32, has a hollow cylindrical stem 305 with an integral front plate 306 formed at its forward tip end and is provided with a continuous thread 307 from the tip end to the center of the stem. A grip 310 extends from the center of the stem towards the rear in an axial direction. The grip has a larger diameter than the stem. A fabric material (identical with that designated 104 in FIG. 18) is made of ductile synthetic resin film which has been charged to an electret state, fiber-split and then crimped to produce a plurality of fiber or fibril bundles (identical with those designated 101 in FIG. 18) arranged in a meandering manner. One end of said bundles is cut while the opposite end is engaged with coil strings (for example, sewn or knitted) identical to those designated by numeral 103 in FIG. 18. Plate 306 is provided with a generally L- or V-shaped notch or slit 306*a* extending from its forward end along the axial direction of the stem, and there is provided, adjacent the end of the thread on said stem 305, an axially extending ridge 308, in which is formed a generally L- or V-shaped formed slit 308*a* directed downwardly from the upper edge of the slit. The material 104 along an edge engaged by strings 103 is wound around and within thread 307, its forward end being sandwiched within said notch 306*a* of the front plate 306, and its rear end being sandwiched within said notch 308*a* of the ridge 308.

According to the invention, the duster has its stem formed with a thread on its circumferential wall, and its grip is threadably mated with a thread formed on a larger diameter circumference of the stem. The one edge of the fabric material engaged by coiled string and which is made of ductile synthetic resin film, charged to the electret state, fiber-split and crimped, is continuously wound around and within the thread on the stem to offer simple and easy fabrication. The grip which is threadably engaged is only detachable upon rotation, and it is never pulled out by an external force during dusting. However, it is easily detachable when desired to permit the easy exchange of the duster portion.

The stem has, at the ends of its threaded portion, generally L- or V-shaped notches or slits which have two triangular projections in cross section at positions opposite to inner faces of said notches so as to narrow the notch widths. This construction permits easy attachment of the fabric material by sandwiching the material in the notches. The material thus is securely fixed therein without chance of escaping therefrom since the material is sandwiched between opposite projections and also is folded toward the deepest portions of the L- or V-shaped notches.

We claim:

1. A duster comprising:

(a) a cylindrical step provided with a continuous thread from a forward tip end thereof to a position intermediate the ends of the stem;

(b) a length of ductile synthetic material split and crimped transversely of its width to form bundles of fibers which are joined together along one edge to form a band, said fibers of the band being electrically charged;

(c) a supporting member secured to the cylindrical stem at said tip end thereof, said member having a hollowed interior bounded by a front plate and a sidewall, said front plate including a first notched portion which communicates with the hollowed interior and with a notch extending along one side of the sidewall and a second notched portion which communicates with the first notched portion and a notch extending along the opposite side of said sidewall, both said first notched portion in the front plate and the notch along said one side of the sidewall being dimensioned so as to allow the entry of the edge portion of a tightly rolled end of said band into the hollowed interior of the supporting member and to retain said edge portion within the hollowed interior upon relaxation of the rolled end, both said second notched portion and the notch along said opposite side of the sidewall being dimensioned so as to allow the unrolled edge portion of the band which is adjacent the rolled end to pass therethrough whereby said unrolled edge portion is positioned to be received in the thread of the cylindrical stem;

(d) means provided at said position intermediate the ends of the stem for securing an end of the band edge received in the cylindrical stem thread; and (e) a grip detachably mated with the unthreaded end of said stem.

2. A duster according to claim 1, wherein said means for securing the end of the band edge comprises an L-shaped notch in the cylindrical stem within which the band edge is received.

* * * * *